United States Patent [19]

Lin

[11] Patent Number: 4,887,583

[45] Date of Patent: Dec. 19, 1989

[54] BRAKING DEVICE FOR SAFETY TOY-GUN

[76] Inventor: Hsien-Chang Lin, 8F-2, 375 Hsin-Yi Rd., Sec.4, Taipei, Taiwan

[21] Appl. No.: 129,804

[22] Filed: Dec. 7, 1987

[51] Int. Cl.[4] ..... F41B 7/08

[52] U.S. Cl. ..... 124/40; 124/31; 273/310; 434/22; 250/221

[58] Field of Search ..... 124/80, 31, 40; 273/310, 311, 312, 313; 434/21, 22; 250/221, 222.1

[56] References Cited

U.S. PATENT DOCUMENTS

| | | | |
|---|---|---|---|
| 2,077,383 | 4/1937 | Foisy | 434/22 |
| 2,869,563 | 1/1959 | Schoengrun | 124/31 |
| 3,230,421 | 1/1966 | Davis | 434/22 |
| 3,788,298 | 1/1974 | Hale | 124/40 |
| 4,470,817 | 9/1984 | Diehl et al. | 434/22 |
| 4,649,893 | 3/1987 | Heitz | 124/40 |

FOREIGN PATENT DOCUMENTS

| | | | |
|---|---|---|---|
| 97139 | 12/1983 | European Pat. Off. | 250/221 |
| 3504198 | 8/1986 | Fed. Rep. of Germany | 434/22 |
| 2337872 | 8/1977 | France | 434/21 |
| 77776 | 6/1981 | Japan | 250/221 |

*Primary Examiner*—Randolph A. Reese

*Assistant Examiner*—Anthony Knight

*Attorney, Agent, or Firm*—Klein & Vibber

[57] ABSTRACT

A safety device for a toy gun has first and second firing pins which can block movement of a trigger. The firing pins are electro-magnetically operated. The first firing pin is normally in a position which blocks movement of the trigger and the second firing pin is normally in a position which allows movement of the trigger. A power source is connected to the first firing pin by a switch so that trigger movement is blocked by the first firing pin until the switch is activated. The switch also connects the power source to a photo-electric switch which includes a light emitter and a light sensor. The second firing pin is connected to the power source by the photo-electric switch so that movement of the trigger is blocked by the second firing pin only when the photo-electric switch is closed. The photo-electric switch detects the presence of a target within a preset range of the toy gun and closes if a target is detected. In this way, the toy gun can be fired only if the first switch is closed and the photo-electric switch is open, i.e. no target detected in range. A preferred embodiment includes a lamp in series with the first firing pin and a buzzer in series with the second firing pin. The photo-electric switch is preferrably infra-red.

3 Claims, 2 Drawing Sheets

BRAKING DEVICE FOR SAFETY TOY-GUN

FIELD OF THE INVENTION

The invention relates to a safety device for a toy gun, in particular a device which prevents firing of a toy projectile when a target is within range of the projectile.

BACKGROUND OF THE INVENTION

Historically, toy guns have been a necessity in the developmental growth of children. According to the analysis of psychologists, the mental behavior of adults is affected by their environment during childhood. Therefore, the development and the design of toys for children have become a matter of concern to society.

It is virtually universal that children, particularly male children, play with aggressive toy weapons like swords and guns. In order to cultivate and train the tough and strong spirits of children, most people allow their children to obtain such kind of toys. Therefore, toy guns have become a major item in toy stores and represent a large proportion of all toy sales.

Because of progress in manufacturing processes and material science, today's toy guns are more sophisticated than ever before. Sound and lighting, electronics, water shooting or even bullet shooting are common features of today's toy guns. Moreover, the outer appearance of some toy guns can even be passed for genuine and this has become a great concern of sociologists.

Because of the reasons stated above, cases of injury due to toy guns are increasing every day. It is a regrettable thing to constantly hear news of the face or the eyes or the body of children being wounded and disabled due to lack of safety knowledge or due to control lost in excitement. However, it is difficult to stop children from playing with toy guns since it may encroach upon children's rights and interests.

In view of the above-mentioned facts, the present inventor has created the present toy gun which can shoot a toy projectile but does not hurt, i.e. through the setting of a safety range and by matching with a signal produced by a photo-electric circuit to control the firing of the toy gun.

SUMMARY OF THE INVENTION

The present invention relates to a safety device for a toy gun, wherein the device can provide an automatic locking effect to stop the firing of a toy projectile if the distance between the gun barrel and the target is within a fixed range. The trigger of the toy gun is locked by means of an infrared photo sensor on the outer surface of the front side of the gun barrel connected with a circuit to control the trigger so that when a target is within a fixed range, the trigger is locked and the toy projectile is not fired. If the target is out of range of the projectile, the infrared photo sensor gives no signal and the trigger is unlocked so the toy projectile can be fired.

BRIEF DESCRIPTION OF THE DRAWINGS

These and other features, which will become apparent in the following detailed description, of the present invention, which is shown by example only, will be clearly understood in connection with the accompanying drawing, in which.

DETAILED DESCRIPTION OF THE PREFERRED EMBODIMENT

Figure 2:
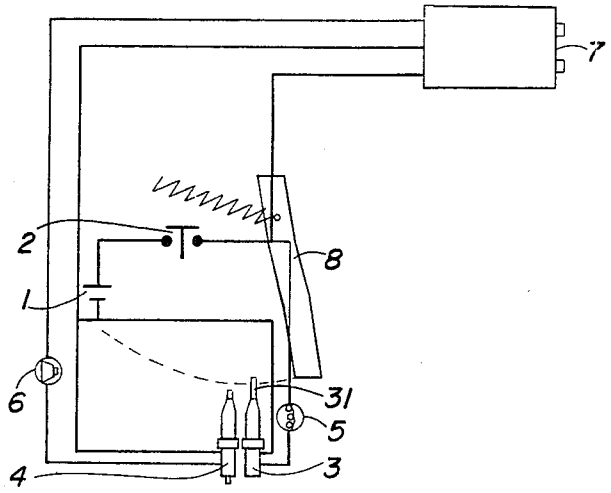
FIG. 2 is a circuit diagram for the present invention, while no power is supplied.
Figure 1:
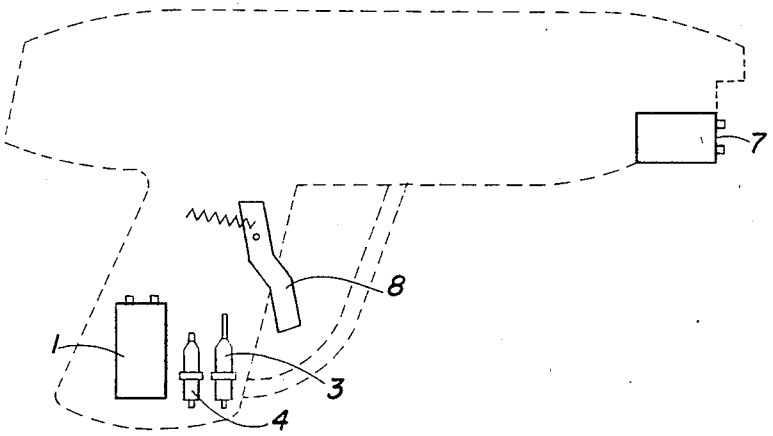
FIG. 1 illustrates a toy gun embodying the present invention.

As shown in FIGS. 1 and 2, the present invention comprises a power source 1, usually a battery, connected with a photo-electric switch 7. The so-called "photo-electric switch 7" comprises both an emitting unit and a receiving unit, as seen in FIGS. 3 and 4.

An instantaneous switch 2, a first firing pin 3, a second firing pin 4, a signal lamp 5, a buzzer 6, and a trigger 8 also form a part of the invention. The so-called "firing pins" 3 and 4 are solenoids activated by an electric current. As shown in FIG. 2, firing pin 3 is normally extended when power is not supplied and firing pin 4 is normally retracted when power is not supplied.

Figure 4:
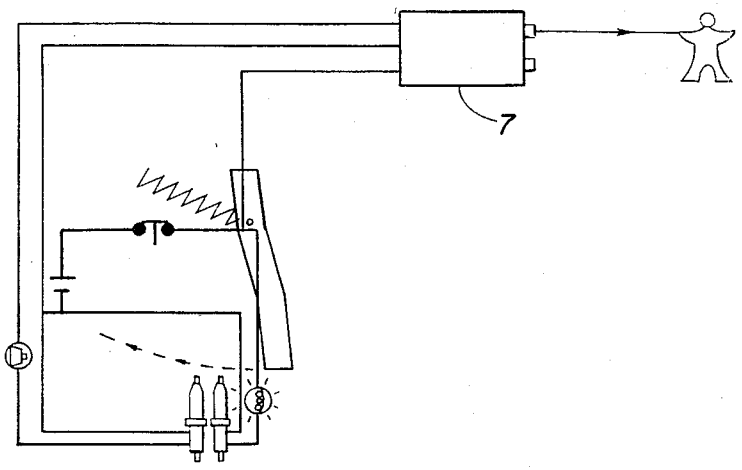
FIG. 4 illustrates the present invention in motion while the target is out of range and the projectile can be fired.
Figure 3:
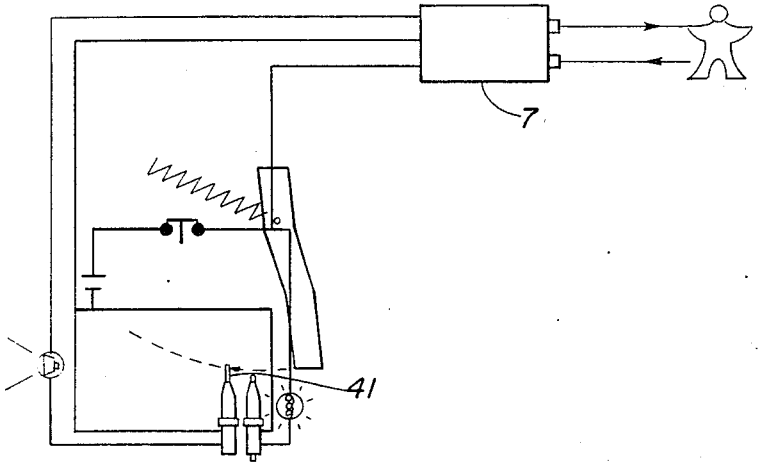
FIG. 3 illustrates the circuit of the present invention in operation while a target is within a fixed range.

As shown in FIGS. 2–4, the photo-electric switch 7 is attached below the barrel of the toy gun and is powered by power source 1 when instantaneous switch 2 is engaged. Power source 1 is also connected through switch 2 and signal lamp 5 to first firing pin 3. Thereby, when switch 2 is engaged, photoelectric-switch 7 is energized, lamp 5 is illuminated and firing pin 3 is retracted.

The second firing pin 4 is powered by power source 1 through photo-electric switch 7 and buzzer 6. Thereby, the buzzer 6 sounds when firing pin 4 is energized and firing pin 4 extends when energized. As will be explained in further detail below, the photo-electric switch 7 energizes the buzzer 6 and firing pin 4 only when a target is sensed to be within a preset range.

The trigger 8 is pivotable on a rivet, e.g., or locating axle to drive a spring to initiate firing. The lower end of the trigger 8 travels in a curve motion which an be blocked by the first firing pin 3 and the second firing pin 4 when they are extended.

As shown in FIG. 2, when no power is supplied to first firing pin 3, the needle or rod 31 of firing pin 3 is extended so as to interrupt the travel of the trigger 8 and the trigger 8 cannot be initiated.

As shown in FIG. 3, when power is supplied by switch 2, lamp 5 is illuminated the needle 31 of the first firing pin 3 is retracted; and when the target is within a fixed safety range (i.e. detectable range), the needle 41 of the second firing pin 4 is extended.

When the photo-electric switch 7 is activated by reflection from a target within the preset range, power is fed through buzzer 6 to second firing pin 4 which causes the needle rod 41 of the second firing pin 4 to extend and interrupt the path of the trigger 8 so that the gun can not fire.

If the trigger 8 is initiated while the target is out of a fixed safety range, as shown in FIG. 4, and if the power is supplied by activation of switch 2, the needle rod 31 of the first firing pin 3 is retracted and the needle rod 41 of the second firing pin 4 is also retracted. Moreover, the buzzer 6 does not sound. Thus, the trigger 8 can freely make a full motion to drive the spring to fire so as to shoot the projectile away.

The following is a table showing the status of first firing pin, second firing pin, photo-electric switch, buzzer and signal lamp, during different operational states:

| Element | Status | | |
|---|---|---|---|
| | No Power | Power supplied Target within fixed range | Power supplied Target out of fixed range |
| Photo-electric Switch | OPEN | CLOSED | OPEN |
| 1st firing pin | EXTENDED | RETRACTED | RETRACTED |
| 2nd firing pin | RETRACTED | EXTENDED | RETRACTED |
| Buzzer | SILENT | BUZZING | SILENT |
| Signal lamp | OFF | ON | ON |
| Firing | DISABLED | DISABLED | ENABLED |

In a preferred embodiment, the detecting range of the photo electric switch can be set within 0–3 meters, the being detectable by attaching to it a 10 cm×10 cm white color reflective object. The reflection time is 5Ms, and the power source is 9 V, i.e., dry cells or button cells or chargeable nickel-cadmium battery by series connection.

As explained above, the present invention can provide following advantages:

1. It provides safety. If the range is set at 70 cm, the projectile that falls over the range has little dynamic force and will make no hurt.

2. It provides a function of sound and lighting. Within a detectable range, the projectile does not shoot but the buzzer buzzes to show that the target is hit. Therefore, it provides a comparable psychological gratification even though no projectile is shot due to safety range.

3. The provision of a signal lamp detects power supply and offers a lighting effect which is also pleasing to a child.

4. The photo-electric circuit design offers high sensitivity and high precision, much better than a mechanical design.

Although the invention is described and illustrated with reference to a preferred embodiment thereof, it is to be expressly understood that it is in no way limited to the disclosure of such preferred embodiment but is capable of numerous modifications within the scope of the appended claims.

I claim:

1. A safety device for a toy gun having a barrel and a trigger for firing a toy projectile, said safety device comprising a power source;

a photo-electric switch mounted on an outer wall surface of the barrel of the gun and connected to said power source by means of a starting switch, said photo-electric switch comprising a light emitter and a light sensor such that said photo-electric switch is closed when an object reflects light emitted by said emitter back to said sensor and said photo-electric switch is open when the emitted light is not reflected to said sensor;

a first electro-magnetic firing pin, said first firing pin being normally in a position so as to block movement of said trigger and prevent firing of said projectile;

said first firing pin being connected in series with said starting switch to said power source, such that when said starting switch is closed, said first firing pin is energized and thereby moved into a position to allow movement of said trigger;

a second electro-magnetic firing pin, said second firing pin being normally in a position so as to allow movement of said trigger and allow firing of said projectile;

said second firing pin being connected in series with said photo-electric switch and said power supply, such that when said photo-electric switch is closed, said second firing pin is energized and thereby moved to a position so as to block movement of said trigger and prevent firing of said projectile.

2. A safety device as claimed in claim 1, further comprising a lamp and a buzzer;

said lamp being connected in series with said first firing pin and said power source such that when said first firing pin is energized, said lamp is illuminated; and said buzzer being connected in series with said second firing pin and said power source such that when said second firing pin is energized, said buzzer sounds.

3. A safety device as claimed in claim 1, wherein the photo-electric switch comprises an infrared photo sensor.

* * * * *